US010193202B2

(12) United States Patent
Sterns et al.

(10) Patent No.: US 10,193,202 B2
(45) **Date of Patent: *Jan. 29, 2019**

(54) SWITCH FOR SWITCHABLE ATTENUATOR AND HIGH FREQUENCY SWITCHABLE ATTENUATOR

(71) Applicant: Rohde & Schwarz GmbH & Co. KG, Munich (DE)

(72) Inventors: Michael Sterns, Nuremberg (DE); Markus Leipold, Isen (DE); Sebastian Sedlmeier, Munich (DE); Markus Freudenreich, Munich (DE); Matthias Freudenreich, Munich (DE); Karl Stockbauer, Regen (DE); Andreas Raith, Prackenbach (DE); Alois Wittenzellner, Geiersthal (DE)

(73) Assignee: Rohde & Schwarz GmbH & Co. KG, Munich (DE)

( * ) Notice: Subject to any disclaimer, the term of this patent is extended or adjusted under 35 U.S.C. 154(b) by 113 days.

This patent is subject to a terminal disclaimer.

(21) Appl. No.: 15/401,074

(22) Filed: Jan. 8, 2017

(65) Prior Publication Data

US 2018/0145387 A1 May 24, 2018

Related U.S. Application Data

(60) Provisional application No. 62/424,260, filed on Nov. 18, 2016.

(51) Int. Cl.
*H01P 1/10* (2006.01)
*H01P 1/22* (2006.01)
(Continued)

(52) U.S. Cl.
CPC ..... *H01P 1/222* (2013.01); *H01H 3/12* (2013.01); *H01P 1/12* (2013.01); *H01P 1/227* (2013.01);
(Continued)

(58) Field of Classification Search
CPC .. H01P 1/127; H01P 1/122; H01P 1/10; H01P 1/222; H01H 3/12; H01H 3/02
(Continued)

(56) References Cited

U.S. PATENT DOCUMENTS 4,070,637 A * 1/1978 Assal ..... H01P 1/10 333/105
4,829,947 A 5/1989 Lequesne
(Continued)

*Primary Examiner* — Stephen E. Jones
(74) *Attorney, Agent, or Firm* — Potomac Technology Law, LLC

(57) ABSTRACT

A switch comprises a first strip conductor and a second strip conductor, arranged orthogonally in a first plane. Moreover, the switch comprises a first switching conductor, having an orthogonally angled shape relative to the first plane. The switch comprises a switching actuator, which is mechanically connected to the first switching conductor and adapted to move vertically relative to the first plane to a first position and to a second position. The switching actuator is configured, so that in the first position, the first strip conductor is in contact with the first switching conductor and the second strip conductor is in contact with the first switching conductor, and so that in the second position, the first strip conductor and the second strip conductor are not in contact with the first switching conductor.

18 Claims, 18 Drawing Sheets

(51) Int. Cl.
*H01H 3/12* (2006.01)
*H01P 1/12* (2006.01)
*H01P 5/04* (2006.01)

(52) U.S. Cl.
CPC ..... *H01P 5/04* (2013.01); *H01H 2239/004* (2013.01)

(58) Field of Classification Search
USPC ..... 333/258, 259, 262, 81 A, 81 R, 81 B
See application file for complete search history.

(56) References Cited

U.S. PATENT DOCUMENTS

| | | | | |
|---|---|---|---|---|
| 4,831,222 | A | 5/1989 | Grellmann et al. | |
| 5,202,658 | A | 4/1993 | Everett et al. | |
| 5,814,907 | A | 9/1998 | Bandera | |
| 5,815,057 | A | 9/1998 | Hoffman et al. | |
| 6,005,459 | A | 12/1999 | Hoffman | |
| 6,650,210 | B1 | 11/2003 | Raklyar et al. | |
| 7,021,603 | B2 | 4/2006 | Wygnaski | |
| 7,078,832 | B2 | 7/2006 | Inagaki et al. | |
| 7,489,179 | B2 | 2/2009 | Kraemer | |
| 7,633,361 | B2 | 12/2009 | Raklyar et al. | |
| 7,843,289 | B1 | 11/2010 | Raklyar et al. | |
| 7,876,185 | B2 | 1/2011 | Trinh et al. | |
| 7,898,122 | B2 | 3/2011 | Andrieux et al. | |
| 2003/0020561 | A1* | 1/2003 | Qiu ..... | H01P 1/127<br>333/105 |
| 2009/0273420 | A1 | 11/2009 | Trinh et al. | |

* cited by examiner

SWITCH FOR SWITCHABLE ATTENUATOR AND HIGH FREQUENCY SWITCHABLE ATTENUATOR

RELATED APPLICATIONS

This application claims the benefit of the earlier filing date under 35 U.S.C. § 119(e) from U.S. Provisional Application Ser. No. 62/424,260 (filed 2016 Nov. 18), which is incorporated herein by reference in its entirety.

FIELD

The present invention relates to high frequency switches for use in attenuation stages of switchable attenuators, in the following also called, step attenuators, and accordingly switchable attenuators.

BACKGROUND

Due to the rise of operating frequencies in communications electronics, the requirements on measurement equipment have been constantly rising in recent years. More specifically, there is a need to constantly increase the frequency of measuring signals. A central component in measuring electronics are switchable attenuators (step attenuators). For example, U.S. Pat. No. 7,489,179 B2 describes a step attenuator for high frequencies. The achievable maximum frequency there though is still limited. Also, the step attenuator shown there requires a large physical footprint.

Accordingly, there is a need for a switch, an attenuation stage and a switchable attenuator allowing for very high frequencies and at the same time only requiring a small spatial volume without incurring great construction costs.

SOME EXAMPLE EMBODIMENTS

Embodiments of the present invention advantageously address the foregoing requirements and needs, as well as others, by providing a switch, an attenuation stage and a switchable attenuator allowing for very high frequencies and at the same time only requiring a small spatial volume without incurring great construction costs.

In accordance with example embodiments of the present invention, a switch is provided. The switch comprises a first strip conductor and a second strip conductor, arranged orthogonally in a first plane. The switch further comprises a first switching conductor, having an orthogonally angled shape in the first plane. The switch further comprises a switching actuator, which is mechanically connected to the first switching conductor and adapted to move vertically relative to the first plane to a first position and to a second position.

According to a further embodiment of the switch, the switching actuator is configured so that in the first position, the first strip conductor is in contact with the first switching conductor and the second strip conductor is in contact with the first switching conductor. The switching actuator is further configured so that in the second position, the first strip conductor and the second strip conductor are not in contact with the first switching conductor. It is thereby possible to achieve a good high frequency behavior while only requiring a small spatial volume of the switch.

According to a further embodiment of the switch, the first strip conductor and the second strip conductor are at least partially enclosed by an electrically conducting strip conductor channel connected to ground. The first strip conductor and the second strip conductor are then separated from the strip conductor channel by an electrically non-conductive gap in the first plane. An especially small spatial volume of the switch can thereby be achieved.

By way of example, the first strip conductor and/or the second strip conductor have a thickness of 0.1-0.5 mm, or more specifically 0.25 mm. By way of further example, first strip conductor and/or the second strip conductor have a width of 0.25-2.0 mm, or more specifically 0.5 mm. By way of further example, the gap has a width of 0.1-0.5 mm, or more specifically 0.25 mm. An especially small spatial volume of the switch can thereby be achieved.

According to a further embodiment of the switch, the first strip conductor and/or the second strip conductor are held in place by axially symmetric non-conductive support elements within the strip conductor channel. It can thereby be assured that the strip conductors have a defined position and are not short-circuited.

According to a further embodiment of the switch, the switching actuator is configured so that, in the second position, the first switching conductor is in contact with a ground plane. This achieves a defined voltage of the first switching conductor during the open-state of the switch. Thereby, resonances of the first switching conductor can be prevented.

According to a further embodiment of the switch, the switch further comprises a third strip conductor, arranged orthogonally to the first strip conductor and opposite to the second strip conductor relative to the first strip conductor in the first plane. The switch further comprises a second switching conductor, having an orthogonally angled shape relative to the first plane. The switching actuator is mechanically also connected to the second switching conductor. The switching actuator is configured so that, in the first position, the first strip conductor and the third strip conductor are not in contact with the second switching conductor, and in the second position, the first strip conductor is in contact with the second switching conductor and the third strip conductor is in contact with the second switching conductor. In this construction, the switch is thereby configured to alternatingly connect the first strip conductor to the second strip conductor by use of the first switching conductor and connecting the first strip conductor to the third strip conductor by use of the second switching conductor.

According to a further embodiment of the switch, the first strip conductor and/or the second strip conductor and/or the third strip conductor are at least partially enclosed by an electrically conducting strip conductor channel connected to ground. The first strip conductor and/or the second strip conductor and/or the third strip conductor are separated from the strip conductor channel by an electrically non-conductive gap in the first plane. An especially small physical volume of the switch can thereby be achieved.

By way of example, the first strip conductor and/or the second strip conductor and/or the third strip conductor have a thickness of 0.1-0.5 mm, or more specifically 0.25 mm. By way of further example, the first strip conductor and/or the second strip conductor and/or the third strip conductor have a width of 0.25-2.0 mm, or more specifically 0.5 mm. By way of further example, the gap has a width of 0.1-0.5 mm, or more specifically 0.25 mm. An especially small spatial volume of the switch can thereby be achieved.

According to a further embodiment of the switch, the first strip conductor and/or the second strip conductor and/or the third strip conductor are held in place by axially symmetric non-conductive support elements within the strip conductor channel. It can thereby be assured that the strip conductors have a defined position and are not short-circuited.

According to a further embodiment of the switch, the switching actuator is configured so that in the first position the second switching conductor is in contact with a ground plane. This achieves a defined voltage of the first switching conductor during the open-state of the switch. Thereby, resonances of the first switching conductor can be prevented.

In accordance with further example embodiments of the present invention, an attenuation stage is provided. The attenuation stage comprises at least two switches according to the foregoing example switch embodiments of the present invention. The second strip conductor of a first switch of the at least two switches is connected to a first terminal of an electrical element. The second strip conductor of a second switch of the at least two switches is connected to a second terminal of the electrical element. The third strip conductor of the first switch is connected with a third strip conductor of the second switch. The first strip conductor of the first switch forms an input terminal of the attenuation stage. The first strip conductor of the second switch forms an output terminal of the attenuation stage. A very small physical footprint of the attenuation stage can thereby be achieved.

According to a further embodiment of the attenuation stage, the electrical element is a resistor formed in thin film technology. An especially small physical footprint of the resulting attenuation stage is thereby achieved.

According to a further embodiment of the attenuation stage, the at least two switches are switches according to specific implementation forms of the first aspect. In this case, the electrical element is disposed on an electrically non-conductive ceramic substrate, such as a silicon-nitride-substrate. By way of example, the ceramic substrate is soldered or pressure welded or glued onto the strip conductor channel. Additionally or alternatively, the electrical element is thermally connected to the strip conductor channel. It is thereby possible to further reduce the physical size of the attenuation stage.

In accordance with further example embodiments of the present invention, a switched attenuator (step attenuator) is provided. The step attenuator comprises an attenuation stage according to the second aspect of the invention. An input terminal of the attenuation stage forms an input terminal of the step attenuator. The output terminal of the attenuation stage forms an output terminal of the step attenuator. It is thereby possible to achieve a small footprint step attenuator which, can achieve very high operating frequencies.

In accordance with further example embodiments of the present invention, a step attenuator is provided. The step attenuator comprises a plurality of attenuation stages according to the foregoing example attenuation stage embodiments of the present invention. The input terminal of a first attenuation stage of the plurality of attenuation stages forms an input terminal of the step attenuator. Further attenuation stages of the plurality of attenuation stages are serially connected so that for each attenuation stage of the further attenuation stages, the output terminal of a preceding attenuation stage is connected to an input terminal of a succeeding attenuation stage. The output terminal of a final attenuation stage of the plurality of attenuation stages forms an output terminal of the step attenuator. A very flexible step attenuator can thereby be achieved.

Still other aspects, features, and advantages of the present invention are readily apparent from the following detailed description, simply by illustrating a number of particular embodiments and implementations, including the best mode contemplated for carrying out the present invention. The present invention is also capable of other and different embodiments, and its several details can be modified in various obvious respects, all without departing from the spirit and scope of the present invention. Accordingly, the drawing and description are to be regarded as illustrative in nature, and not as restrictive.

BRIEF DESCRIPTION OF THE DRAWINGS

Embodiments of the present invention are illustrated by way of example, and not by way of limitation, in the figures of the accompanying drawings, in which like reference numerals refer to similar elements, and in which.

DETAILED DESCRIPTION

Approaches for a switch, an attenuation stage and a switchable attenuator allowing for very high frequencies and at the same time only requiring a small spatial volume without incurring great construction costs, are described. It is apparent, however, that the invention may be practiced without these specific details or with an equivalent arrangement. In other instances, well-known structures and devices are shown in block diagram form in order to avoid unnecessarily obscuring the invention.

Figure 9:
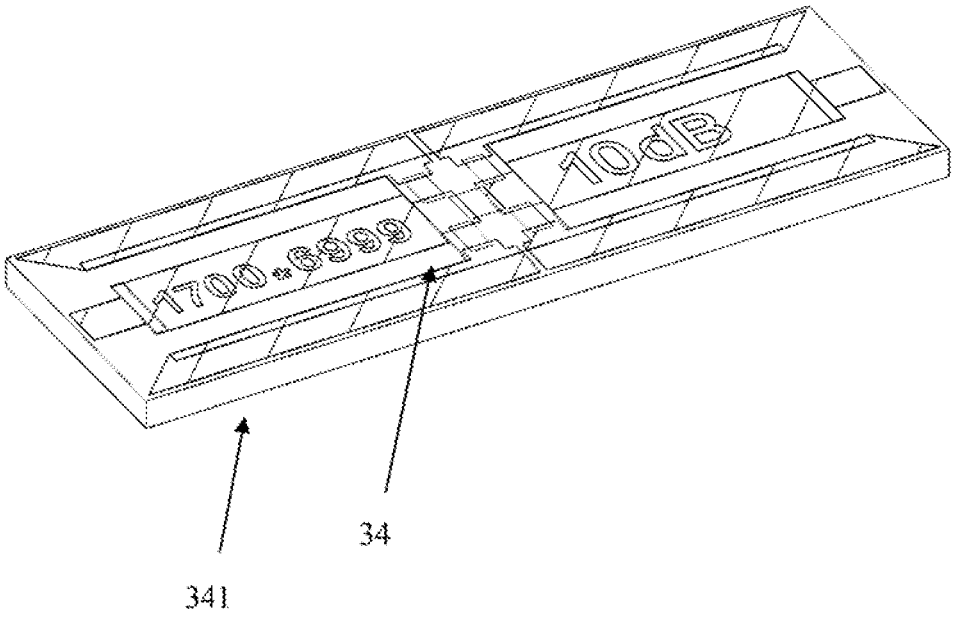
FIG. 9 shows a detailed view of an electrical element of an example attenuation stage according example embodiments of the present invention.
Figure 10:
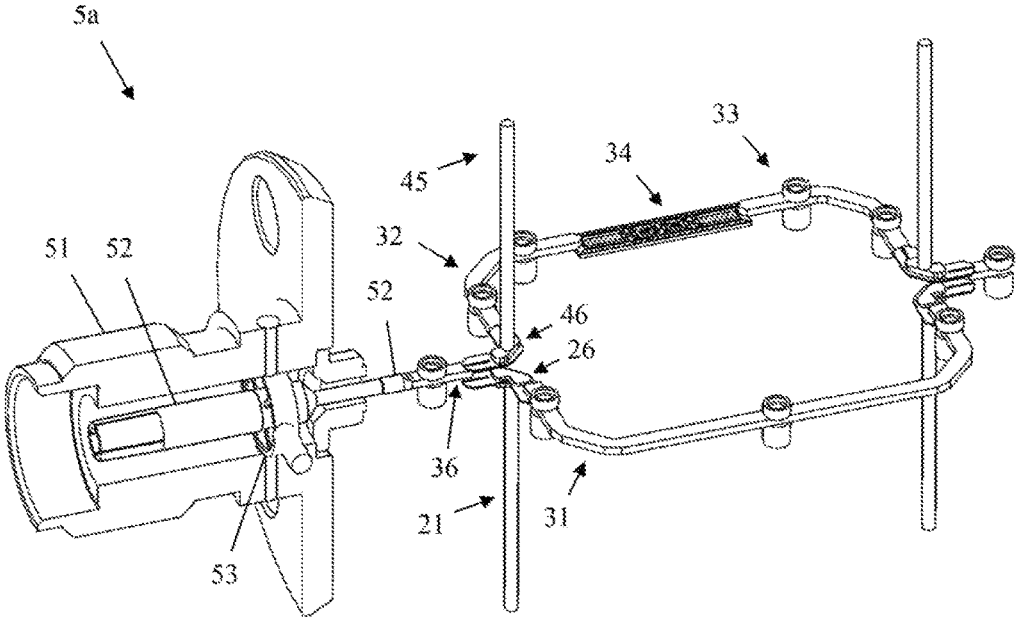
FIG. 10 shows an input terminal of an example switch attenuator or step attenuator according example embodiments of the present invention.
Figure 11:
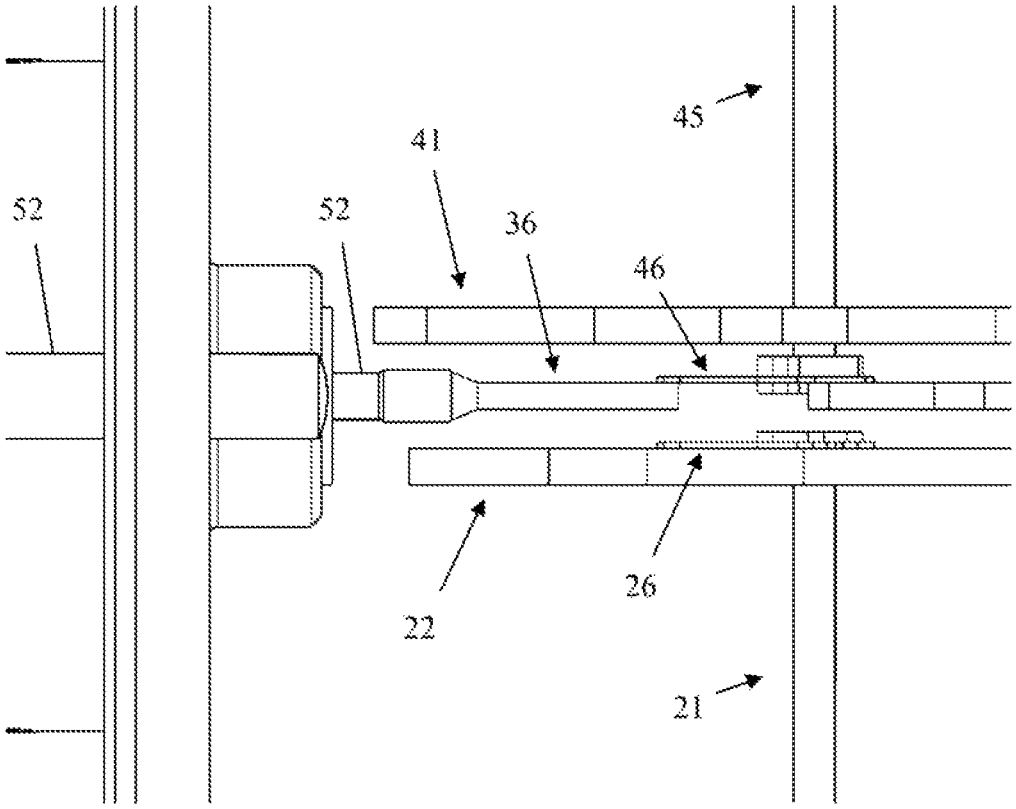
FIG. 11 shows a side-view of an example switch attenuator or step attenuator according example embodiments of the present invention.
Figure 16:
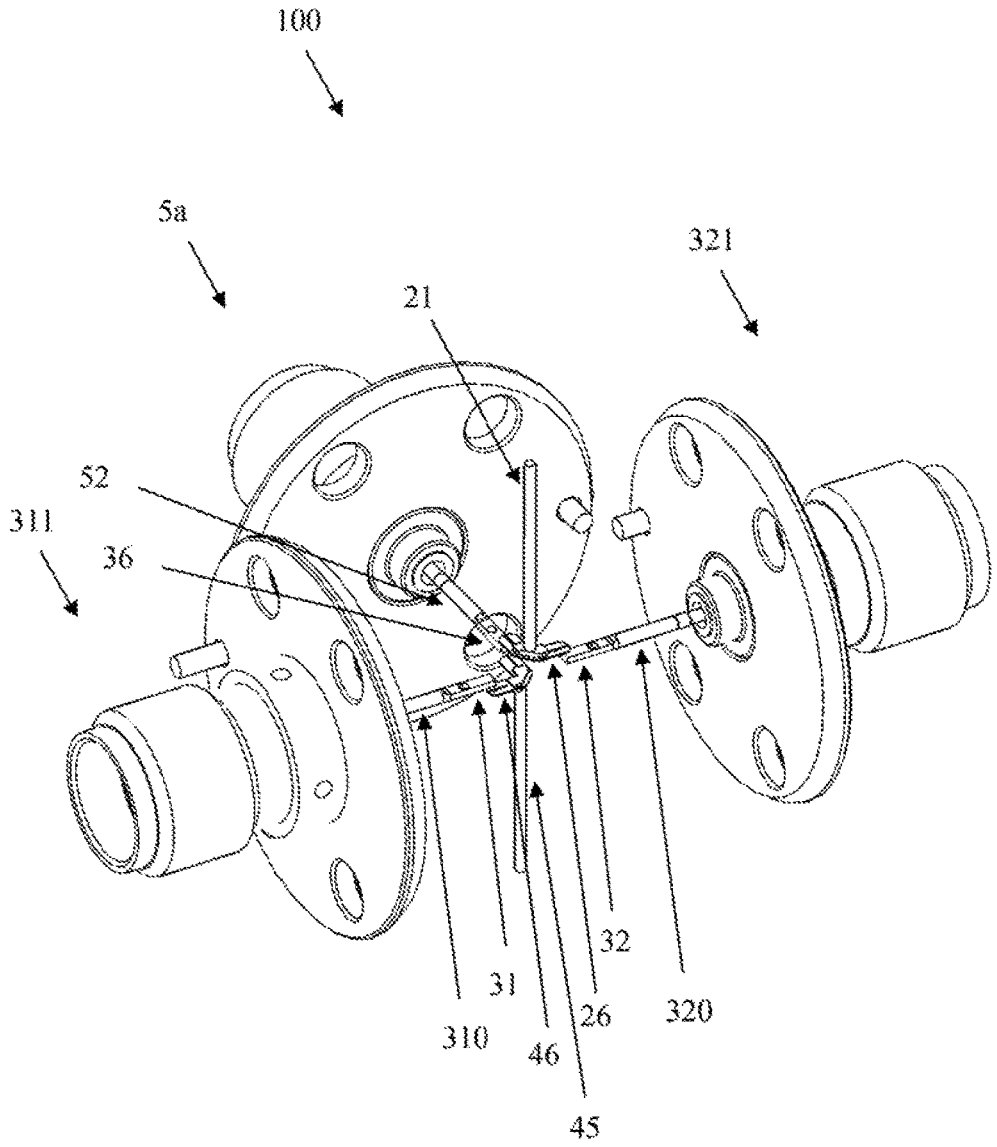
FIG. 16 shows a selector switch as a further embodiment of an example switch according example embodiments of the present invention.
Figure 17:
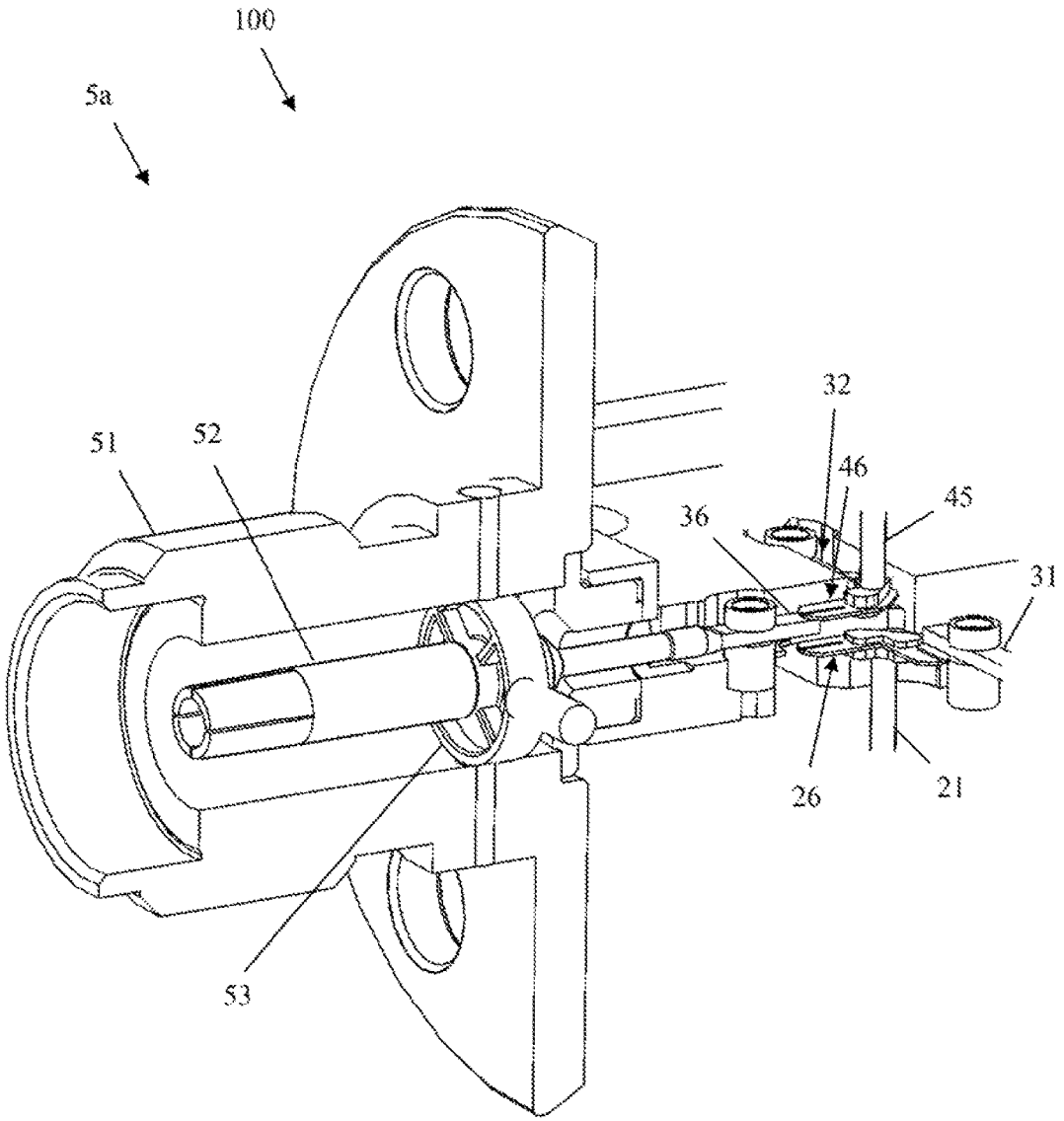
FIG. 17 shows an input position of a selector switch as a further embodiment of a switch according example embodiments of the present invention.
Figure 18:
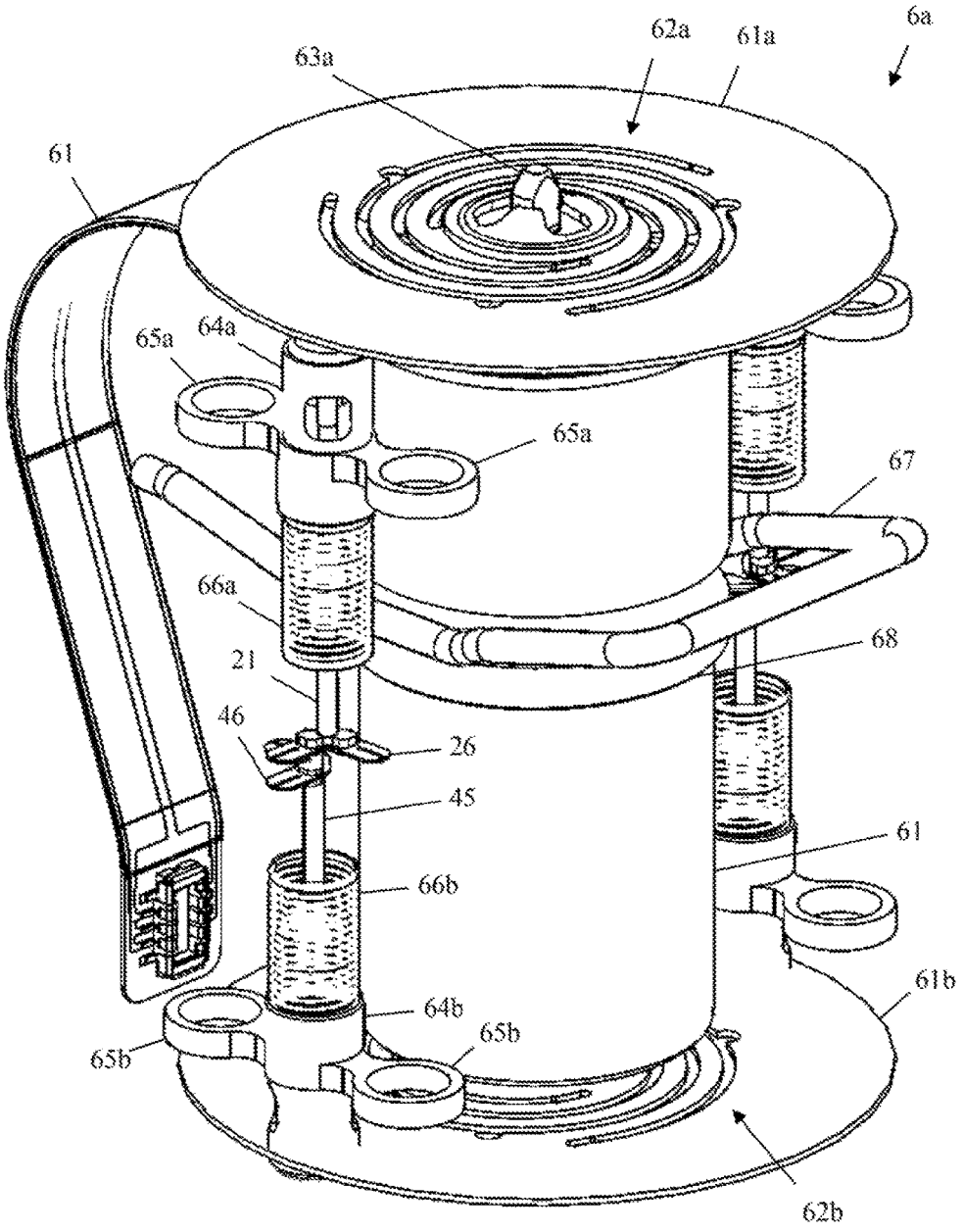
FIG. 18 shows an actuator of an example switch according example embodiments of the present invention.
Figure 19:
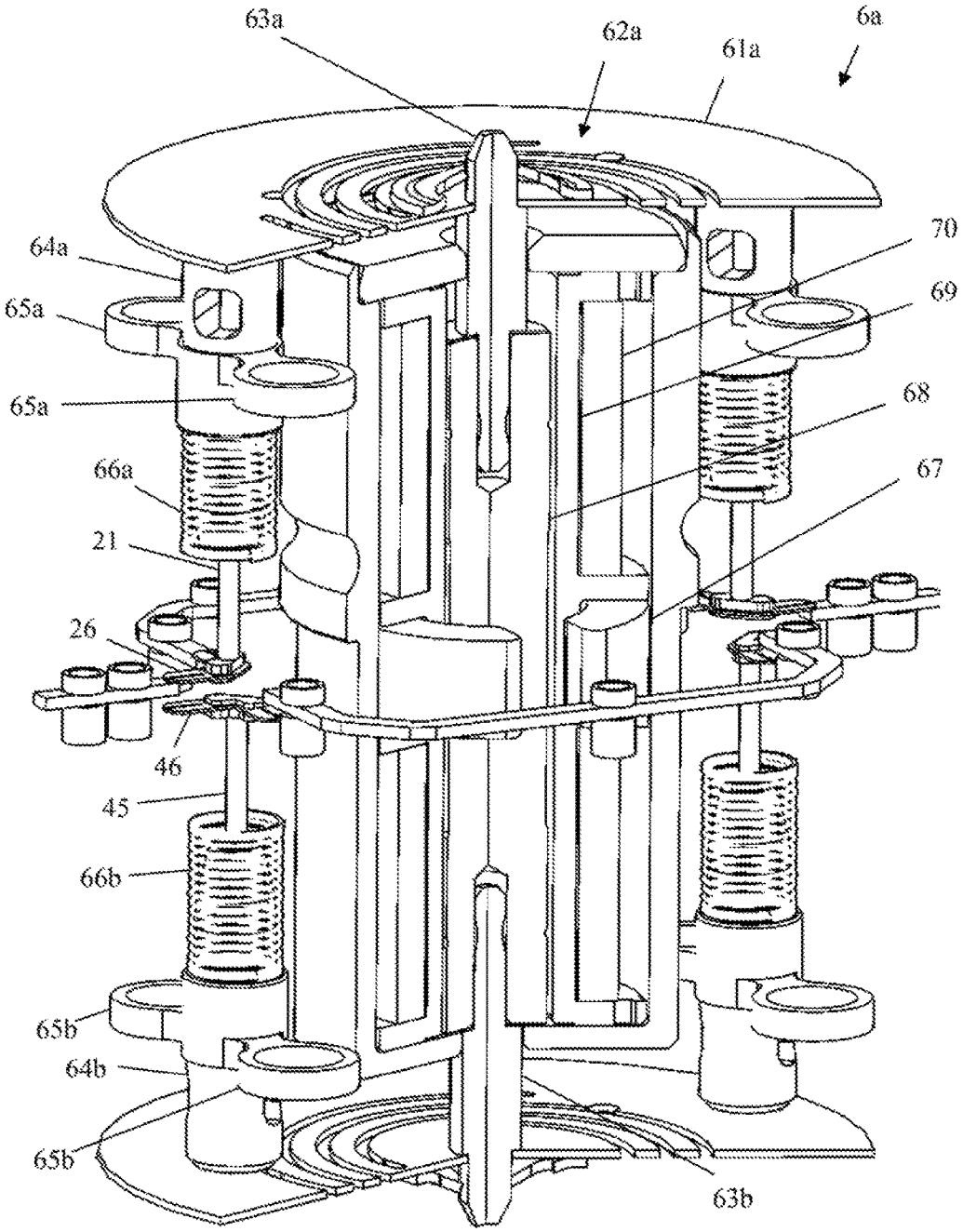
FIG. 19 shows a cut-open view of an actuator of an example switch according example embodiments of the present invention.

First the general construction of a multi-stage step attenuator is described with reference to FIGS. 1-5. Second, with reference to FIGS. 6-8, details of the conductors within the step attenuator (switchable attenuator) are described. With reference to FIG. 9, the construction of an electrical element within the step attenuator is described. With reference to FIGS. 10-11, an input port situation of the step attenuator is described. With reference to FIGS. 12-15, details of the construction of a switching conductor and surrounding elements is described. With reference to FIGS. 16-17, the construction of an exemplary selector switch is described. With reference to FIGS. 18-19, the construction and function of a switching actuator is described. In the following description, similar entities and reference numbers in different figures have been partially omitted.

Reference will now be made in detail to the preferred embodiments of the present invention, examples of which are illustrated in the accompanying drawings. However, the following embodiments of the present invention may be variously modified and the range of the present invention is not limited by the following embodiments.

Figure 1:
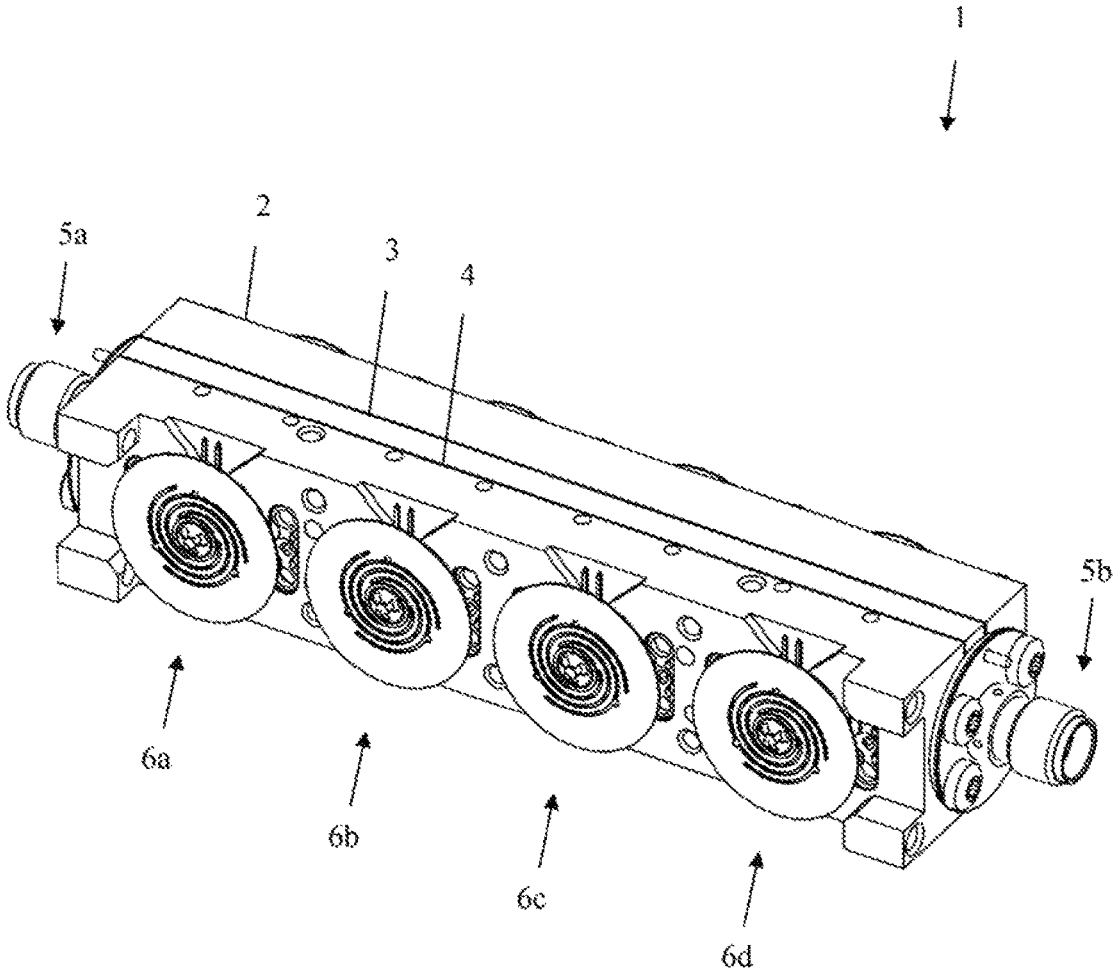
FIG. 1 shows an example step attenuator according example embodiments of the present invention.

FIG. 1 shows an example step attenuator 1 according example embodiments of the present invention. The step attenuator 1 includes an input port 5*a* and an output port 5*b*. The step attenuator 1 further comprises a lower housing 2, a baseplate 3 and an upper housing 4. The lower housing 2 and the upper housing 4 sandwich the baseplate 3. Moreover, the step attenuator 1 comprises a number of attenuation stages, which are not separately depicted here. The attenuation stages are arranged between the input port 5*a* and the output port 5*b*. Each attenuation stage has an actuator 6*a*, 6*b*, 6*c*, 6*d*. With each of the actuators 6*a*-6*d*, it is possible to switch an electrical element, for example a resistor into the signal path between the input port 5*a* and the output port 5*b*.

Figure 2:
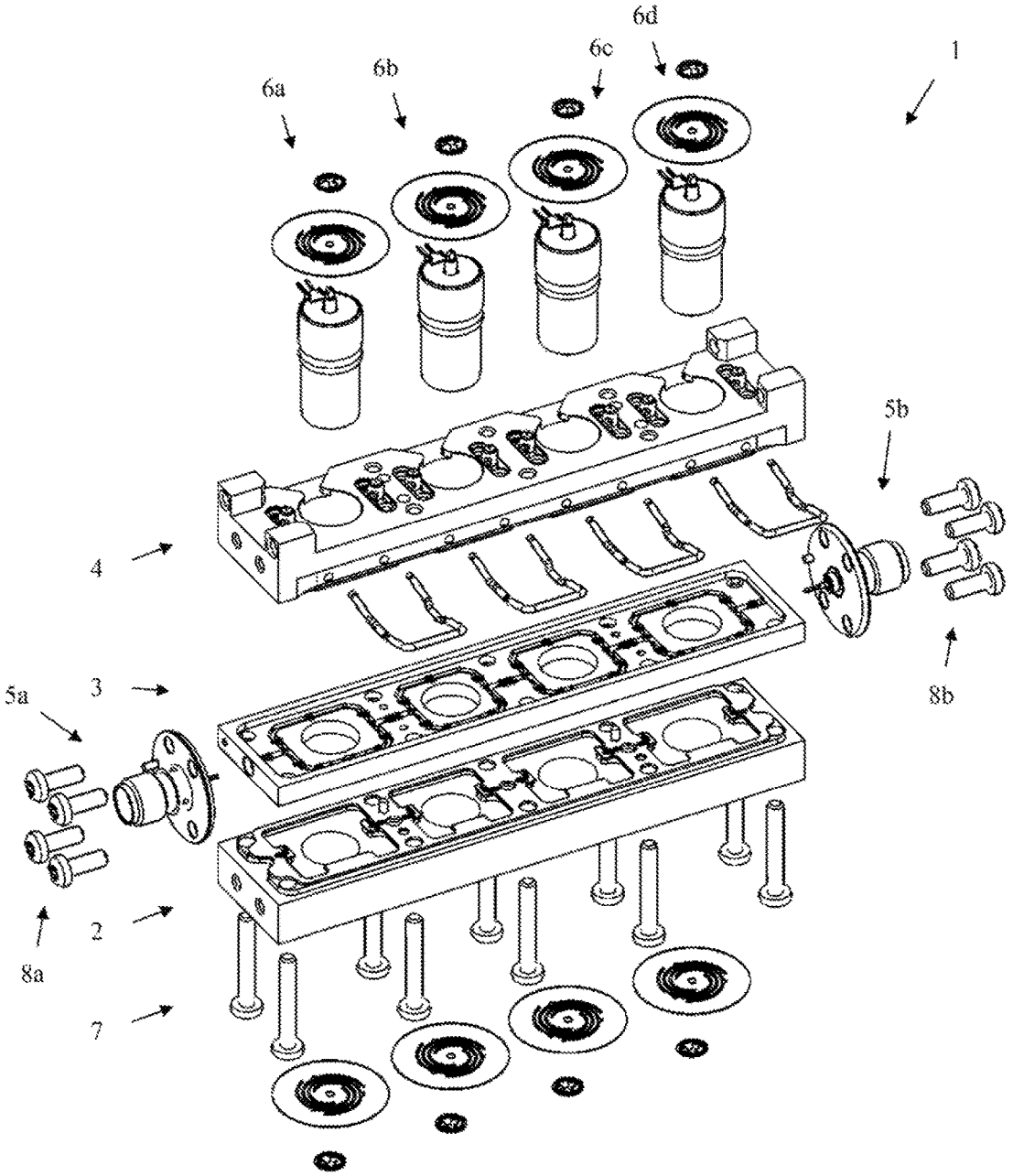
FIG. 2 shows an expanded view of an example step attenuator according example embodiments of the present invention.

FIG. 2 shows an expanded view of the step attenuator 1 of FIG. 1. It can clearly be seen here that the input port 5*a* is held in place by bolts 8*a*, which screw into the upper housing 4 and the lower housing 2. Also, the output port 5*b* is held in place by bolts 8*b*, which also screw into the upper housing 4 and the lower housing 2. The upper housing 4, the baseplate 3 and the lower housing 2 are moreover held together by bolts 7.

Further details of the individual elements will be given in the further figures.

Figure 3:
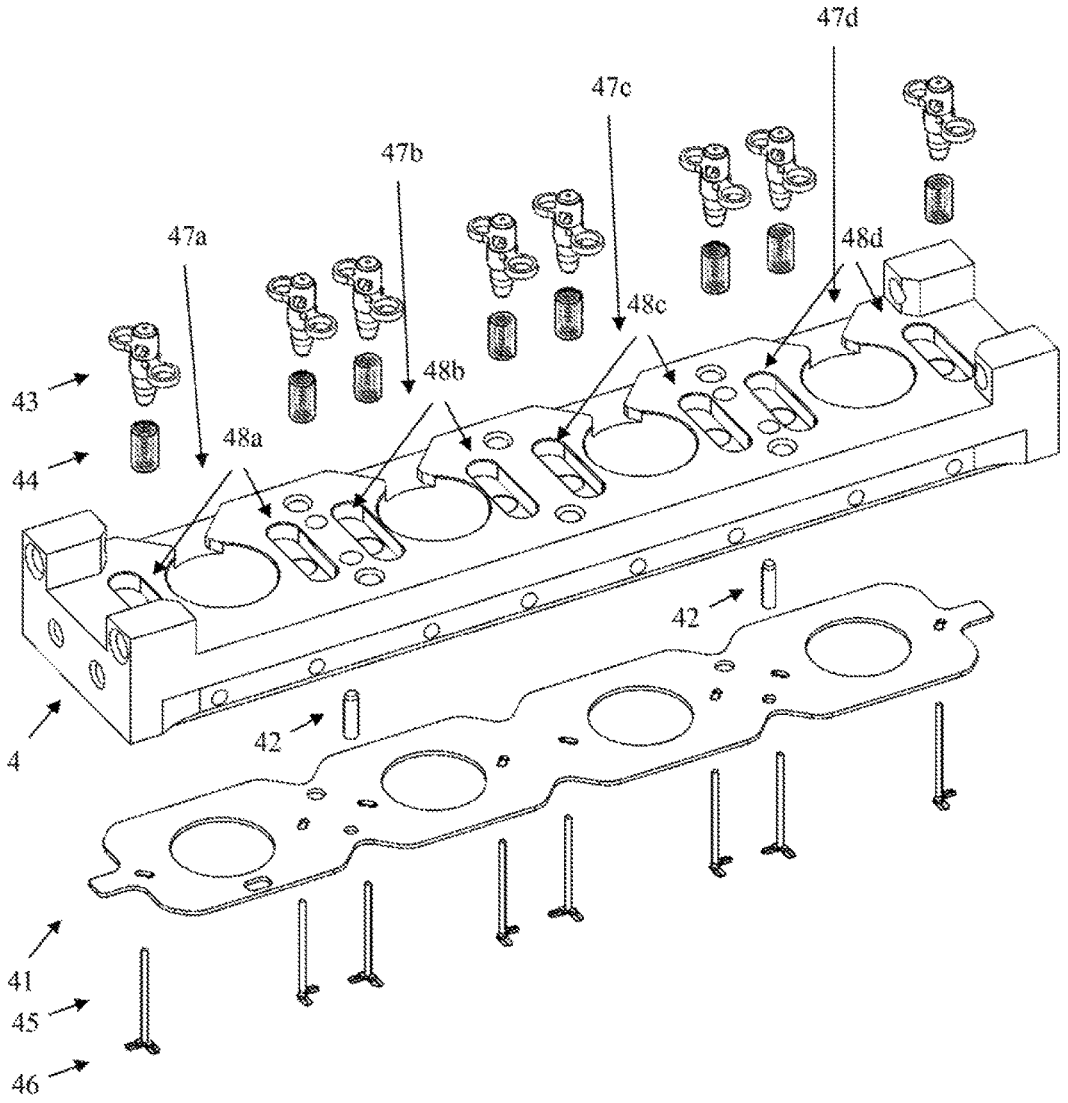
FIG. 3 shows an expanded view of an upper housing of an example step attenuator according example embodiments of the present invention.

FIG. 3 shows a detailed view of the upper housing 4 and surrounding components of the step attenuator 1 of FIG. 1. The upper housing 4 comprises a number of holes 47*a*, 47*b*, 47*c*, 47*d*, which are configured for passing an actuator 6*a*-6*d* through. Moreover, the upper housing 4 comprises additional holes 48*a*, 48*b*, 48*c*, 48*d* for passing through connecting rods 45, which are attached to switching conductors 46 on their lower side and shafts 43 on their upper side. Between the respective shaft 43 and the upper housing 4, additionally a respective spring 44 is arranged, holding the connecting rod 45 and the attached shaft 43 under tension. Below the upper housing 4, a high frequency sealing sheet 41 is arranged. Bolts 42 keep the upper housing 4, the sealing sheet 41 and the baseplate 3 aligned.

Figure 4:
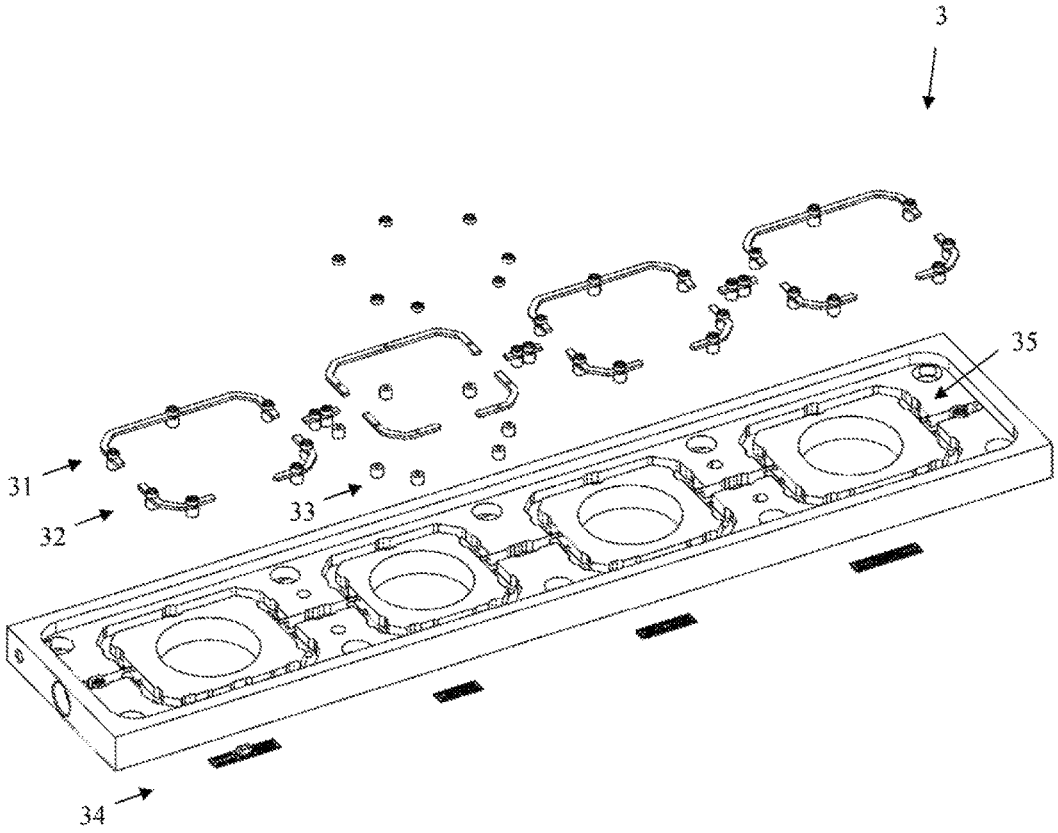
FIG. 4 shows an expanded view of a baseplate of an example step attenuator according example embodiments of the present invention.

FIG. 4 shows an expanded view of an example baseplate 3 of the step attenuator 1 of FIG. 1. The baseplate 3 comprises a strip conductor channel 35, which connects the input port side and the output port side of the baseplate 3. For each of the attenuation stages of the step attenuator 1, the strip conductor channel 35 forms two paths, one path for a through connection and one path for a connection with an electrical element 34. Within the strip conductor channel 35 strip conductors 31 and 32 are arranged. The strip conductor 31 forms the respective through connection in each of the attenuation stages. The strip conductor 32 connects the electrical element 34 of the respective stage. Within each of the attenuation stages, switches on an input side and on an output side, switch either the strip conductor 31 or the strip conductor 32 into the signal path between the input port and the output port.

The strip conductors 31, 32 are held in place by axially symmetric non-conductive support elements 33.

The strip conductor channel 35 has a conductive surface. By way of example, the strip conductor channel 35 is machined into the baseplate 3, which is formed from solid metal. Since the support elements 33 hold the strip conductors 31, 32 with a gap towards the strip conductor channel 35, there is no conductive connection between the strip conductors 31, 32 and the strip conductor channel 35. Also, there is no conductive connection between the electrical elements 34 and the strip conductor channel. Further, the components are configured to exhibit good thermal coupling between the electrical elements 34 and the strip conductor channel and therefore the baseplate 3, which achieves dissipation of the signal power.

Figure 5:
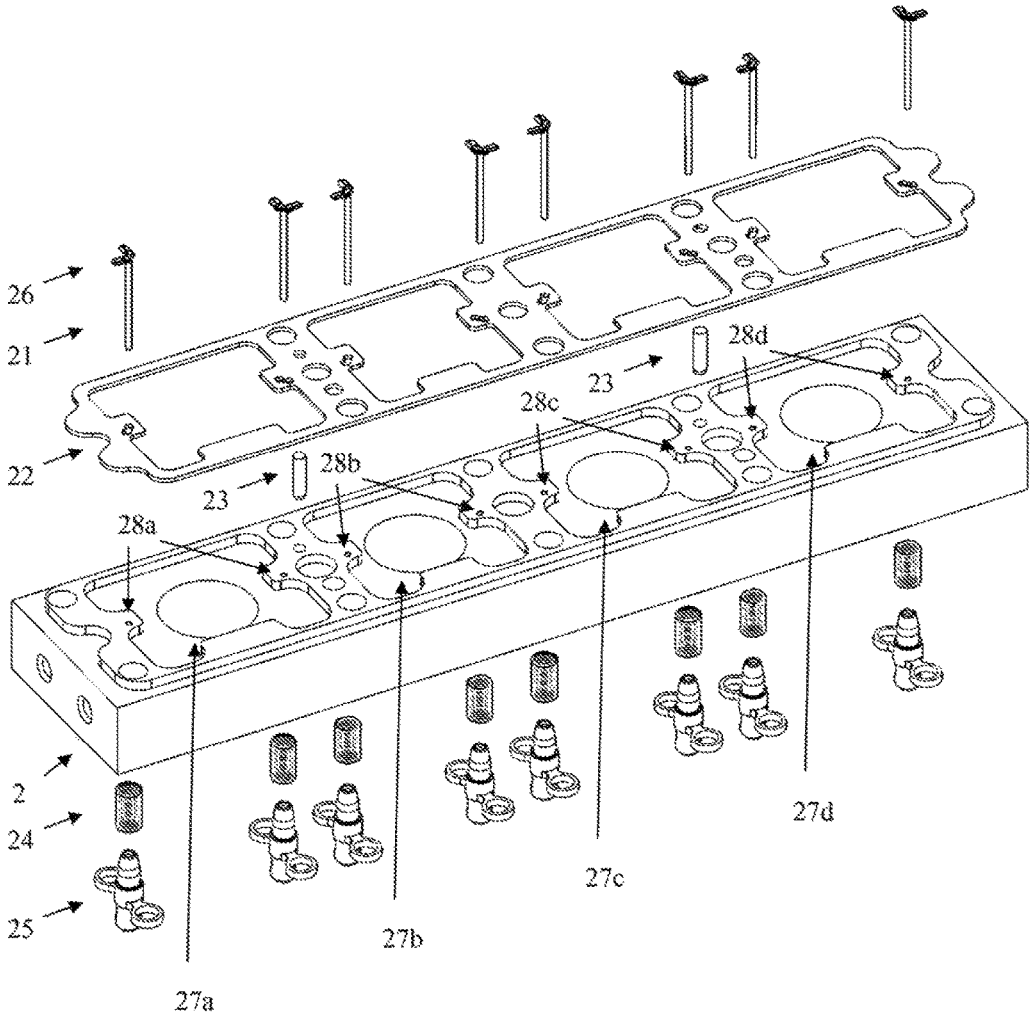
FIG. 5 shows an expanded view of a lower housing of an example step attenuator according example embodiments of the present invention.

FIG. 5 shows an expanded view of an example lower housing 2 of the step attenuator 1 of FIG. 1. Also here, a high frequency sealing sheet 22 is arranged between the lower housing 2 and the baseplate 3. Bolts 23 hold the lower housing 2, the high frequency sealing sheet 22 and the baseplate 3 aligned. The lower housing 2 comprises a number of holes 27*a*, 27*b*, 27*c* and 27*d* for passing an actuator 6*a*-6*d* through. Moreover, the lower housing 2 as well as the high frequency sealing sheet 22 comprise additional holes 28*a*, 28*b*, 28*c* and 28*d* for passing connecting rods 21 through. The connecting rods 21 are attached to switching conductor 26 on the upper side and to shafts 25 on the lower side. Between the lower housing and the respective shaft 25, for each connecting rod 21, a spring 24 is arranged, holding the shafts and the connecting rods at tension relative to the lower housing 2.

Figure 6:
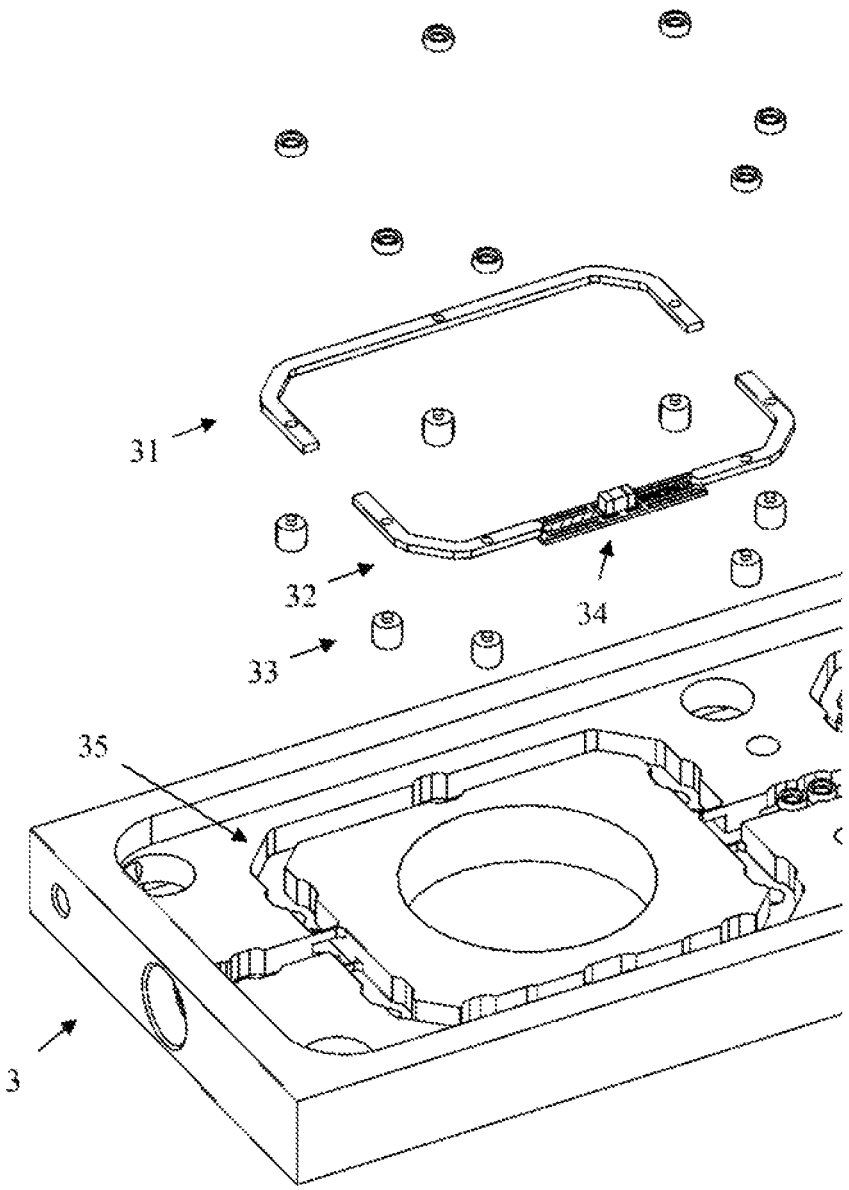
FIG. 6 shows a detailed expanded view of a baseplate of an example step attenuator according example embodiments of the present invention.

FIG. 6 shows an expanded view of the example baseplate 3 of FIG. 5. Here, the strip conductors 31 and 32 are shown in an expanded view relative to the baseplate 3. It can clearly be seen that the strip conductor 31 forms a through connection between a left side and a right side of the baseplate 3, while the strip conductor 32 forms a connection between the left side and the right side of the baseplate 3 through the electrical element 34. Also, the support elements 33 can easily be seen here. Moreover, this figure clearly shows the strip conductor channel 35, which is machined into the baseplate 3.

Figure 7:
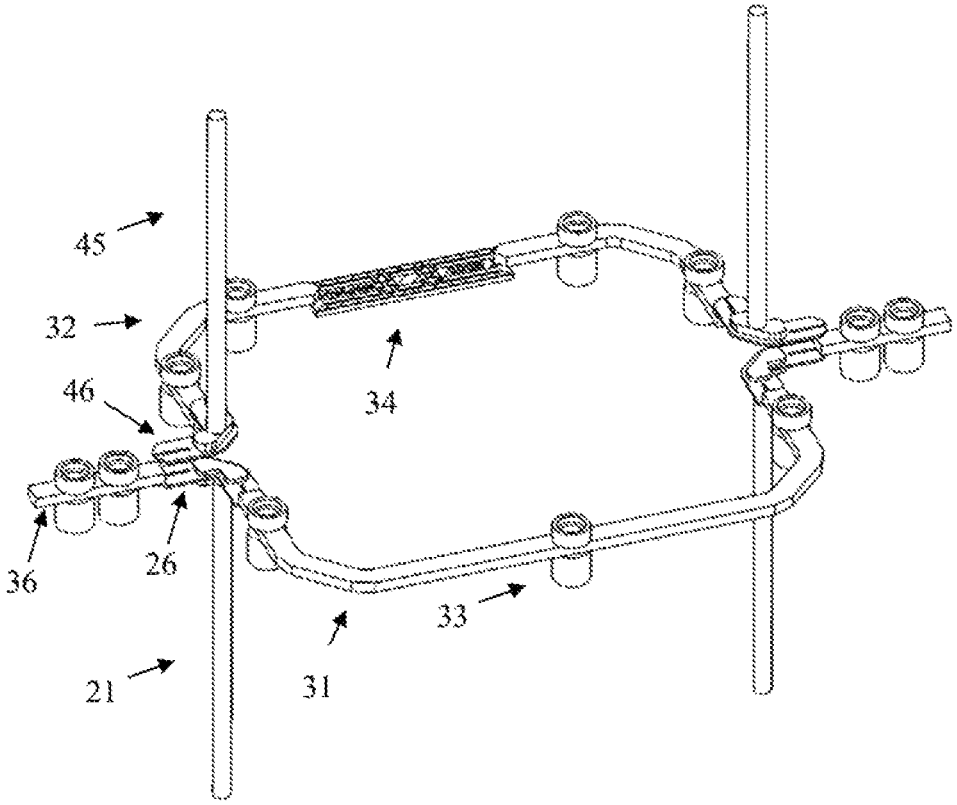
FIG. 7 shows a detailed view of two switches according example embodiments of the present invention.

FIG. 7 shows a detailed view of two example switches, without the surrounding baseplate 3 and housing 2, 4, according example embodiments of the present invention.

Since the two switches are constructed identically, only the left switch is provided with reference signs.

A first strip conductor 36 forms an input of the switch. The first strip conductor 36 can be connected to the strip conductor 32, which connects the electrical element 34 and alternatively to the strip conductor 31, which forms the through connection as explained earlier.

The switch comprises an upper connecting rod 45, connected to a first switching conductor 46 and a lower connecting rod 21, connected to a second switching conductor 26. The connecting rods 45, 21 are connected to one of the actuators 6*a*-6*d* and are moved simultaneously.

The switches, can be positioned in a first position and in a second position. In the first position shown here, the switching conductor 46 is not in contact with the first strip conductor 36 and the second strip conductor 32. The switching conductor 46 instead is contact with a ground plane, for example the upper housing or the high frequency sealing sheet 22 arranged between the upper housing and the baseplate 3. At the same time, the switching conductors 26 is in contact with the first strip conductor 36 and the third strip conductor 31. The further switch switches in a similar manner. This means that either the second strip conductor 32 or the third strip conductor 31 is connected with the input and output of the respective attenuation stage.

By way of example, the switching conductors 26, 46 are orthogonally shaped in the plane of the strip conductors, and the first strip conductor 36 is arranged orthogonally relative to the second strip conductor 32 and the third strip conductor 31. This achieves an advantageous high frequency behavior, since a high frequency coupling to the presently non-switched path is effectively prevented due to the orthogonal nature of the electromagnetic field.

Figure 8:
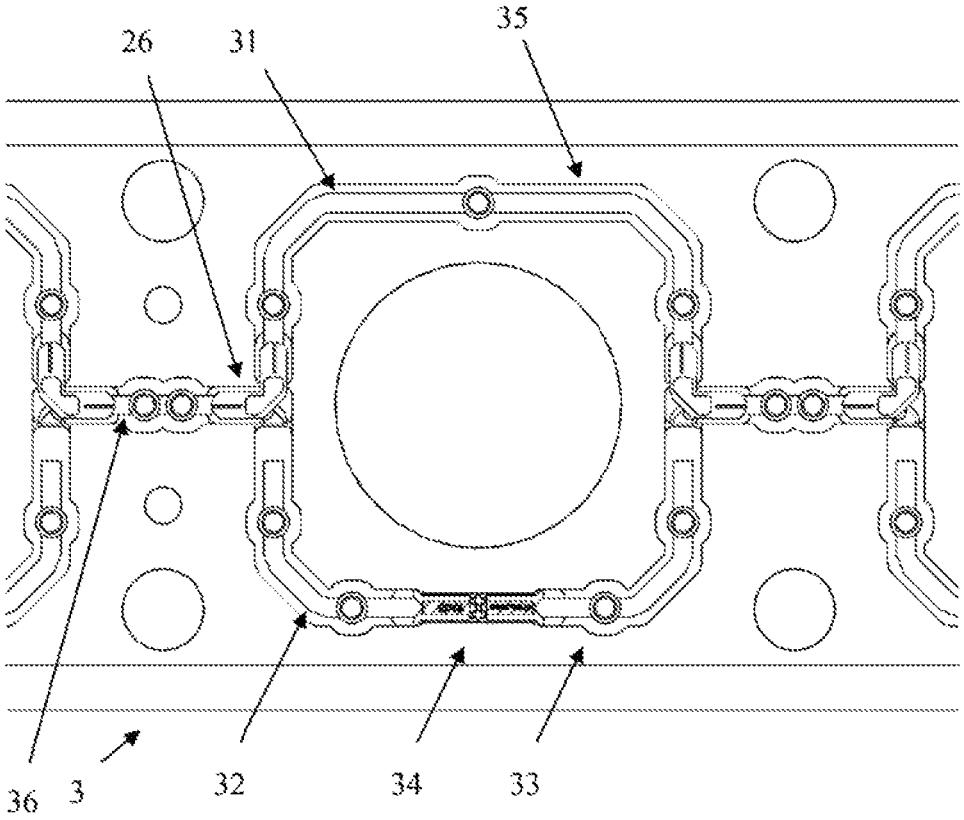
FIG. 8 shows a top-down view of the two switches within an example step attenuator according example embodiments of the present invention.

FIG. 8 shows a top-down view of one example attenuation stage of a step attenuator according example embodiments of the present invention. Here the first strip conductor 36, the switching conductor 26 and the strip conductors 31, 32 are shown. Also the electrical element 34 and the support elements 33 can readily be seen. Moreover, the strip conductor channel 35 is also depicted here.

FIG. 9 shows a detailed view of an example electrical element 34 of an attenuation stage according example embodiments of the present invention. The electrical element 34 is arranged on a substrate 341, especially a ceramic substrate. For example a silicon-nitride substrate can be used. This is advantageous, because such a substrate has a high temperature conductivity, which facilitates dissipation of a high signal power away from the electrical element 34. By way of example, in order to thermally connect the substrate 341 to the surrounding, it is soldered or pressure welded or glued, directly onto the surface of the baseplate 3 within the strip conductor channel 35. Since the substrate 341 itself is non-conductive, this does not constitute a short-circuit between the electrical element and the strip conductor channel 35.

FIG. 10 shows an example input port 5*a* and a connected attenuation stage. The input port 5*a* comprises an outer conductor 51 and an inner conductor 52 and forms a coaxial port. The inner conductor 52 is held in place by a conductor support 53. The inner conductor 52 is formed as one piece with the first strip conductor 36. This allows for a very simple construction and very beneficial high frequency behavior. As already described earlier, the first strip conductor can be switched to connect to the second strip conductor 32 or the third strip conductor 31. The already earlier described elements, although depicted here, are not described again.

FIG. 11 shows a side-view of an example input port situation depicted in FIG. 10. It is evident here that the inner conductor 52 is formed as one piece with the first strip conductor 36. Further, here the position of the switching conductor 46 and 26 and the high frequency sealing sheets 41, 22 can clearly be seen.

In the present switching position, the switching conductor 46 is in contact with the first strip conductor 36 and the second strip conductor 32. At the same time, the switching conductor 26 is in contact with the ground plane formed by the high frequency seal 22. In the other switching position, the switching conductor 26 is in contact with the first strip conductor 36 and the third strip conductor 31. At this time, the switching conductor 46 is in contact with the ground formed by the high frequency seal 41.

Figure 12:
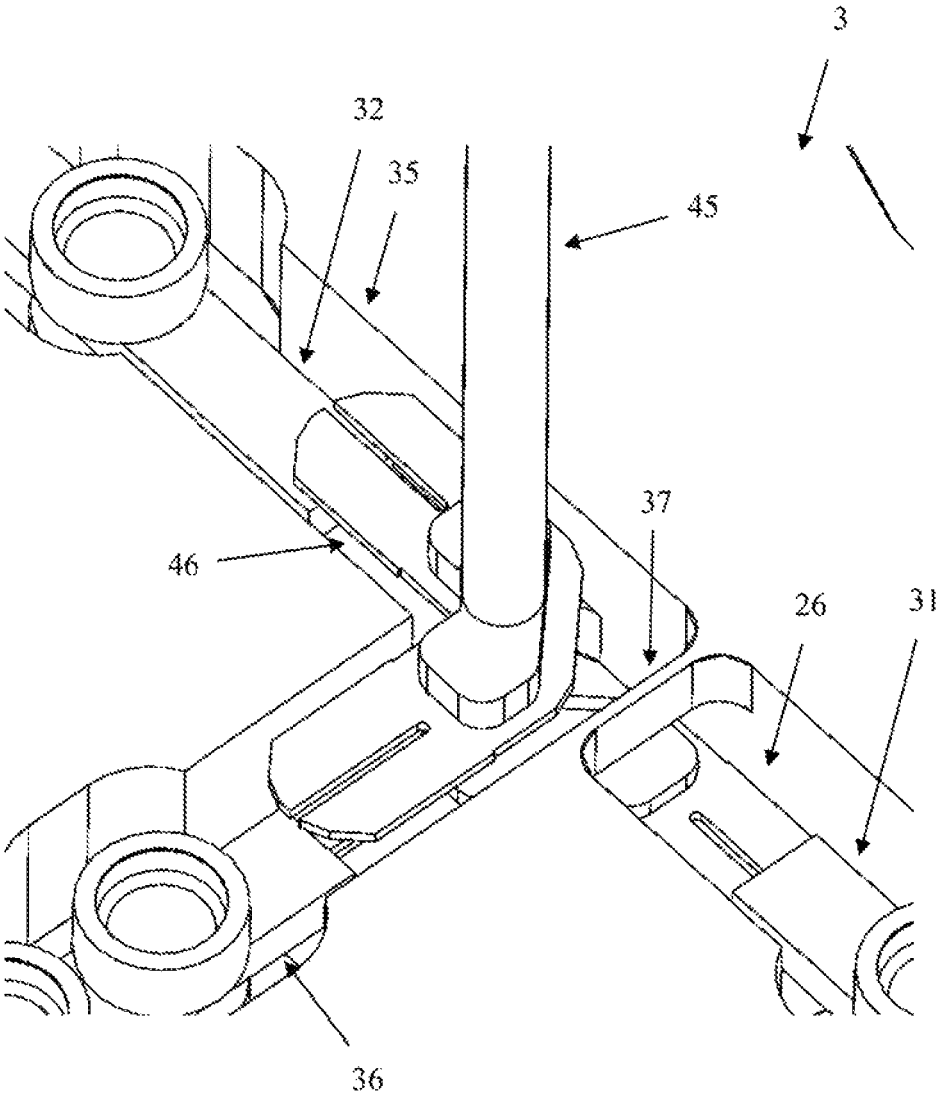
FIG. 12 shows a detailed view of strip conductors and switching conductors in an example switch according example embodiments of the present invention.

FIG. 12 shows a three dimensional view of the baseplate 3 surrounding the switching conductors 46, 26. The baseplate 3 has a strip conductor channel 35 machined into its surface. The first strip conductor 36, the second strip conductor 32 and the third strip conductor 31 are each arranged within this strip conductor channel 35 separated from the strip conductor channel by a gap. By way of example, the gap has a width of 0.1-0.5 mm, or more specifically 0.25 mm. By way of further example, the strip conductors 31, 32, 36 have a width of 0.25-2.0 mm, or more specifically 0.5 mm. By way of further example, the strip conductors 31, 32 and 36 have a thickness of 0.1-0.5 mm, or more specifically 0.25 mm.

The switching conductor 46 is connected to the connecting rod 45. The switching conductor 46 in this picture is not in contact with the first strip conductor 36 and the second strip conductor 32. Instead, the switching conductor 26 is in contact with the first strip conductor 36 and the third strip conductor 31. This is though not easily visible in this picture.

Further, that the baseplate 3 has a strip conductor channel wall 37 arranged at the bend of the perpendicular shaped switching conductor 46, separating the switching conductor 46 from the third strip conductor 31. For example an RF coupling of a signal between the third strip conductor and the switching conductor 46 is thereby prevented. A similar strip conductor channel wall 38 is arranged between the second strip conductor 32 and the switching conductor 26. This can readily be seen in FIG. 13.

Figure 13:
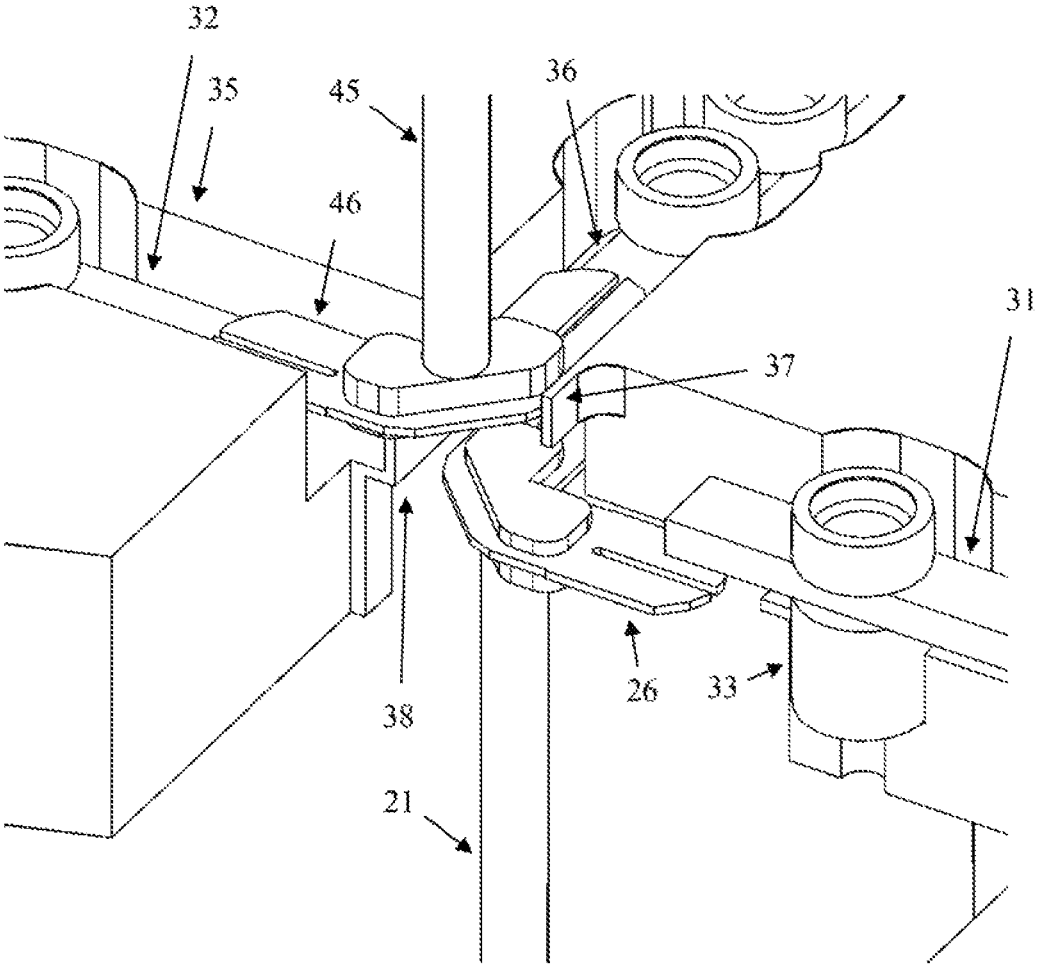
FIG. 13 shows a further detailed view of strip conductors and switching conductors in an example switch according example embodiments of the present invention.

FIG. 13 shows a cut-open view corresponding to the view of FIG. 12. Here, the two switching conductors 46, 26 can readily be seen. Also the two high frequency channel walls 37, 38 are easily recognizable.

Figure 14:
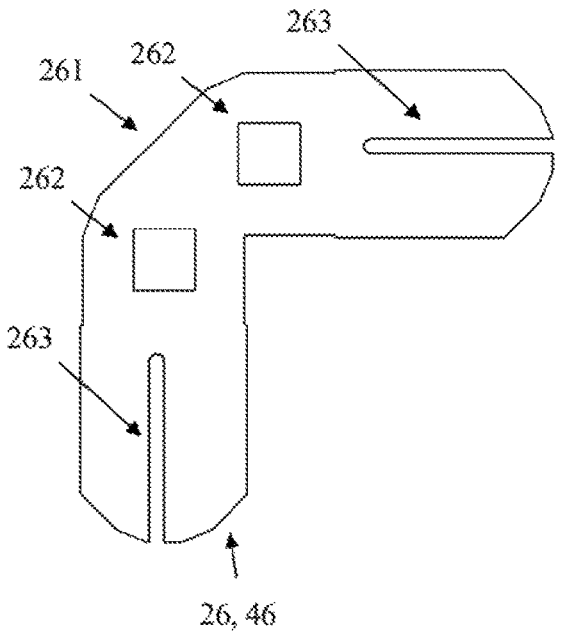
FIG. 14 shows a detailed view of a switching conductor in an example switch according example embodiments of the present invention.

FIG. 14 shows a detailed view of the switching conductors 26, 46. Each of the switching conductors 26, 46 comprises holes 262 near the bend of its perpendicular shape. These holes 262 are used for connecting the connecting rod 21, 45. By way of example, this may be achieved by injection molding the connecting rod 21, 45, for example from a plastic material, wherein the material of the connecting rod 21, 45 flows through the holes 262 and surrounds the switching conductor 26, 46, thereby connecting and holding the switching conductor 26, 46 by the connecting rod 21, 45.

Moreover, the switching conductor 26, 46 can optionally comprise a flattened corner 261 in order to enhance the high frequency behavior.

Furthermore, optionally, the switching conductor 26, 46 can comprise slits 263 in its respective distal ends. These slits are useful for increasing the elasticity of the respective tips of the switching conductor 26, 46, thereby decreasing accuracy requirements regarding the exact positioning of the strip conductors 31, 32, 36.

Figure 15:
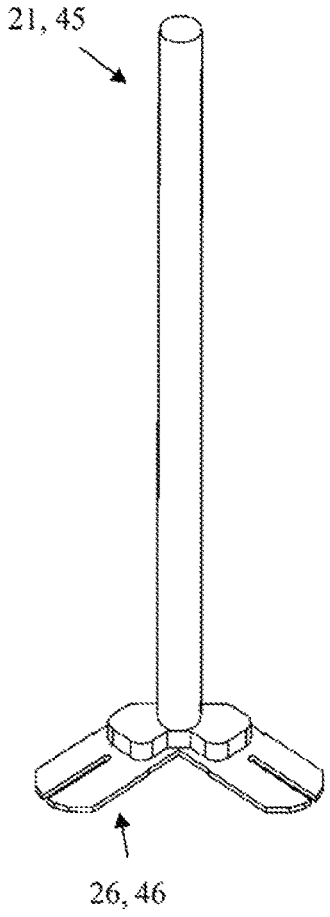
FIG. 15 shows a detailed view of a switching conductor and a connecting rod in an example switch according example embodiments of the present invention.

FIG. 15 shows a detailed view of the switching conductor 26, 46 in connection to the connecting rod 21, 45.

FIG. 16 shows an example application of a selector switch 100 as a switch according example embodiments of the present invention. Here, the switch is used in a selector switch, for switching between different high frequency connectors 5*a*, 311, 321. The switch 100 comprises a first high frequency connector 5*a*, a second high frequency connector 321 and a third high frequency connector 311.

The first high frequency connector 5*a* comprises a first inner conductor 52 integrally formed with a first strip conductor 36. The second high frequency connector 321 comprises an inner conductor 320, integrally formed with a second strip conductor 32. The third high frequency connector 311 comprises a third inner conductor 310 integrally formed with a third strip conductor 31.

By way of example, the first strip conductor 36 is arranged orthogonally relative to the second strip conductor 32 in the first plane. Within the same first plane, the first strip conductor 36 is arranged orthogonally to the third strip conductor 31.

By way of further example, the inner conductors 52, 320, 310 of the high frequency connectors 5*a*, 321, 311 are each arranged in line with the respectively integrally formed strip conductor 36, 32, 31. Therefore, also the high frequency connectors 5*a*, 321, 311 are arranged in a similar configuration to the respective strip conductor 36, 32, 31. This means that the first high frequency connector 5*a* is arranged orthogonally to the second high frequency connector 321. Also the first high frequency connector 5*a* is arranged orthogonally to the third high frequency connector 311.

According to a further embodiment, the switch 100 further comprises a first switching conductor 26 connected to a connecting rod 21 and a second switching conductor 46 connected to a connecting rod 45. The connecting rods 21, 45 are connected to a non-depicted switching actuator, which moves the connecting rods 21, 45 simultaneously and thereby also moves the switching conductors 26, 46 simultaneously. The switching actuator is configured to move the switching conductors 26, 46 between a first position and a second position. In the first position, the first switching conductor 26 is in contact with the first strip conductor 36 and the second strip conductor 32, while the second switching conductor 46 is not in contact with any of the strip conductors 36, 32, 31 but instead to a ground plane. In the second position, the second switching conductor 46 is in contact with the first strip conductor 36 and the third strip conductor 31, while the first switching conductor 26 is not in contact with any of the strip conductors 36, 32, 31 but instead to a ground plane.

This means that the first switching conductor 26 in FIG. 16 is lowered onto the first strip conductor 36 and the second strip conductor 32 in the first position, while the second switching conductor 46 is moved downwards away from the strip conductor 36, 32, 31. In the second position, the second switching conductor 46 is moved upwards towards the lower side of the first switching conductor 36 and the third switching conductor 31, while the first switching conductor 26 is moved away from the upper side of the switching conductor 36, 32, 31.

FIG. 17 shows an input position of one of the input high frequency connectors 5*a* as a switch according example embodiments of the present invention. The high frequency connector 5*a* comprises an outer conductor 51 and an inner conductor 52. In this example, the conductors 51, 52 form a co-axial connector. Within the high frequency connector 5*a*, a port support 53 is arranged, which holds the inner conductor 52 within the outer conductor 51 in a non-conductive manner. Since the inner conductor 52 is integrally formed with the first strip conductor 36, the port support 53 also holds the first strip conductor 36 in position. On the right side of FIG. 17, the identical components already depicted in FIG. 16 are shown again, but not described in detail, here.

FIG. 18 shows a detailed view of a switching actuator 6*a* of an example switch according example embodiments of the present invention. The actuators 6*a*-6*d* are identical to each other.

The actuator 6*a* comprises a ridge 68 and is held in place by a securing spring 67, which locks in the ridge 68 and holds the actuator in its place in the respective hole of the upper housing, lower housing and baseplate.

Moreover, the actuator 6*a* comprises an actuator-element 63*a*, 63*b*, which is moved up and down by the actuator 6*a* between a first position and a second position. The actuator-element 63*a* is connected to an elastic element 61*a* on the top side of the actuator 6*a* and to a second elastic element 61*b* on the bottom side of the actuator 6*a*. The actuator-element 63*a* moves a first side of the elastic elements 61*a*, 61*b*, which corresponds to the central part of the respective elastic elements 61*a*, 61*b*. In this example, the elastic elements 61*a*, 61*b* are diaphragm springs. They comprise a number of slits 62*a*, 62*b*, by which the elastic characteristic of the diaphragm springs can be tuned.

Connected to a second side of the elastic elements 61*a*, 61*b* are shafts 64*a*, 64*b*, which are connected to the connecting rods 21, 45, which in turn are connected to the switching conductors 26, 46. The shafts 64*a*, 64*b* are moreover connected to springs 66*a*, 66*b*, which on their respective other side are in contact with the outer side of the baseplate, exerting an elastic force, forcing the respectively connected switching conductors 26, 46 away from each other.

The shafts 64*a*, 64*b* are moreover supplied with loops 65*a*, 65*b*, which are used for preventing the shafts 64*a*, 64*b* from rotating.

The actuator 6*a* is provided with shafts 64*a*, 64*b*, connecting rods 21, 45 and switching conductors 26, 46 on a left side and on a right side and therefore are symmetrical. They are adapted to move the switches simultaneously, as also depicted in FIG. 7 and FIG. 10. Therefore, one actuator 6*a* is used for two switches and therefore for one attenuation stage according to the second aspect.

The actuator 6*a* is supplied with a switching current through a cable 61.

FIG. 19 shows a cut-open view of the actuator 6*a* of FIG. 18. The elements already described along FIG. 16 are not described again here. The actuator 6*a* comprises the before-described actuator-element 63*a*, 63*b*, which is formed in conjunction with a core 68. The actuator-element 63*a*, 63*b* moves together with the core 68 within a housing 69.

Arranged within the housing 69 and fixed to the housing is a permanent magnet 67. Moreover an electromagnet 70 is arranged fixed to the housing 69. The core 68 along with the actuator element 63*a*, 63*b* is therefore movable relative to the permanent magnet 67 and the electromagnet 70.

The permanent magnet 67 makes sure, that there is always a magnetic force pulling the actuator-element 63*a*, 63*b* either towards a first switching position or a second switching position. This means that the core 68 is either in contact with an upper side of the housing 69 or a lower side of the housing 69. The magnetic force is in equilibrium in a central position, but this position is not stable. Therefore, the actuator is bi-stable in the two switching positions. By running a switching current through the electromagnet 70, the magnetic force of the permanent magnet 67 is overpowered, thereby allowing a switching between the two stable states.

In FIG. 19, in addition to the depiction in FIG. 18, the strip conductors are shown.

The invention is not limited to the examples. The invention discussed above can be applied to many different types of switches, attenuation stages and step attenuators. Further, the type of actuator is not to be understood as limiting. The characteristics of the example embodiments can be used in any combination.

Although the present invention and its advantages have been described in detail, it should be understood, that various changes, substitutions and alterations can be made herein without departing from the spirit and scope of the invention as defined by the appended claims.

While various embodiments of the present invention have been described above, it should be understood that they have been presented by way of example only, and not for limitation. Numerous changes to the disclosed embodiments can be made in accordance with the disclosure herein without departing from the spirit or scope of the invention. Thus, the breadth and scope of the present invention should not be limited by any of the above-described embodiments. Rather, the scope of the invention should be defined in accordance with the following claims and their equivalents.

Although the invention has been illustrated and described with respect to one or more implementations, equivalent alterations and modifications will occur to others skilled in the art upon the reading and understanding of this specification and the annexed drawings. In addition, while a particular feature of the invention may have been disclosed with respect to only one of several implementations, such feature may be combined with one or more other features of the other implementations as may be desired and advantageous for any given or particular application.

What is claimed is:

1. A switch comprising:

a first strip conductor and a second strip conductor arranged orthogonally in a first plane;

a first switching conductor configured in an orthogonally angled shape relative to the first plane; and a switching actuator mechanically connected to the first switching conductor, and configured to move vertically, relative to the first plane, to a first position and to a second position.

2. The switch of claim 1, wherein the switch is configured in one or more of the following manners:

one or more of the first strip conductor and the second strip conductor have a thickness of 0.1 mm to 0.5 mm; and one or more of the first strip conductor and the second strip conductor have a width of 0.25 mm to 2.0 mm.

3. The switch of claim 1, wherein one or more of the first strip conductor and the second strip conductor are held in place by axially symmetric non-conductive support elements within the strip conductor channel.

4. The switch of claim 1, wherein the first strip conductor and the second strip conductor are at least partially enclosed by an electrically conducting strip conductor channel connected to ground, and wherein the first strip conductor and the second strip conductor are separated from the strip conductor channel by an electrically non-conductive gap in the first plane.

5. The switch of claim 4, wherein the gap has a width of 0.1 mm to 0.5 mm.

6. The switch of claim 1, wherein the switching actuator is configured whereby, in the first position, the first strip conductor is in contact with the first switching conductor and the second strip conductor is in contact with the first switching conductor, and, in the second position, the first strip conductor and the second strip conductor are not in contact with the first switching conductor.

7. The switch of claim 6, wherein the switching actuator is configured whereby, in the second position, the first switching conductor is in contact with a ground plane.

8. The switch of claim 6, further comprising:

a third strip conductor arranged orthogonally to the first strip conductor and opposite to the second strip conductor relative to the first strip conductor in the first plane; and a second switching conductor configured in an orthogonally angled shape relative to the first plane; and wherein the switching actuator is mechanically connected to the second switching conductor, wherein the switching actuator is configured whereby, in the first position, the first strip conductor and the third strip conductor are not in contact with the second switching conductor, and wherein the switching actuator is configured whereby, in the second position, the first strip conductor is in contact with the second switching conductor, and the third strip conductor is in contact with the second switching conductor.

9. The switch of claim 8, wherein one or more of the first strip conductor, the second strip conductor and the third strip conductor are held in place by axially symmetric non-conductive support elements within the strip conductor channel.

10. The switch of claim 8, wherein the switching actuator is configured whereby, in the first position, the second switching conductor is in contact with a ground plane.

11. The switch of claim 8, wherein one or more of the first strip conductor, the second strip conductor and the third strip conductor are at least partially enclosed by an electrically conducting strip conductor channel connected to ground, and wherein one or more of the first strip conductor, the second strip conductor and the third strip conductor are separated from the strip conductor channel by an electrically non-conductive gap in the first plane.

12. The switch of claim 11, wherein the switch is configured in one or more of the following manners:

one or more of the first strip conductor, the second strip conductor and the third strip conductor have a thickness of 0.1 mm to 0.5 mm;

one or more of the first strip conductor, the second strip conductor and the third strip conductor have a width of 0.25 mm to 2.0 mm; and wherein the gap has a width of 0.1 mm to 0.5 mm.

13. An attenuation stage of a switchable attenuator, comprising at least two switches, wherein each of the switches comprises:

a first strip conductor and a second strip conductor arranged orthogonally in a first plane;

a first switching conductor configured in an orthogonally angled shape relative to the first plane;

a switching actuator mechanically connected to the first switching conductor, and configured to move vertically, relative to the first plane, to a first position and to a second position;

a third strip conductor arranged orthogonally to the first strip conductor and opposite to the second strip conductor relative to the first strip conductor in the first plane; and a second switching conductor configured in an orthogonally angled shape relative to the first plane; and wherein the switching actuator is mechanically connected to the second switching conductor, wherein the switching actuator is configured whereby, in the first position, the first strip conductor is in contact with the first switching conductor, the second strip conductor is in contact with the first switching conductor, and the first strip conductor and the third strip conductor are not in contact with the second switching conductor, and wherein the switching actuator is configured whereby, in the second position, the first strip conductor and the second strip conductor are not in contact with the first switching conductor, the first strip conductor is in contact with the second switching conductor, and the third strip conductor is in contact with the second switching conductor; and wherein the second strip conductor of a first of the at least two switches is connected to a first terminal of an electrical element, wherein the second strip conductor of a second of the at least two switches is connected to a second terminal of the electrical element, wherein the third strip conductor of the first switch is connected to the third strip conductor of the second switch, wherein the first strip conductor of the first switch forms an input terminal of the attenuation stage, and wherein the first strip conductor of the second switch forms an output terminal of the attenuation stage.

14. The attenuation stage according to claim 13, wherein the electrical element is a resistor formed in thin film technology.

15. The attenuation stage according to claim 13, wherein:

for each of the at least two switches, one or more of the first strip conductor, the second strip conductor and the third strip conductor are at least partially enclosed by an electrically conducting strip conductor channel connected to ground, and wherein one or more of the first strip conductor, the second strip conductor and the third strip conductor are separated from the strip conductor channel by an electrically non-conductive gap in the first plane; and the electrical element is disposed on an electrically non-conductive ceramic substrate, and wherein the ceramic substrate is one of soldered, pressure welded and glued onto the strip conductor channel, and/or the electrical element is thermally connected to the strip conductor channel.

16. The attenuation stage according to claim 15, wherein the electrically non-conductive ceramic substrate is a Silicon-Nitride-Substrate.

17. A switchable attenuator comprising a one attenuation stage that comprises at least two switches, wherein each of the switches comprises:

a first strip conductor and a second strip conductor arranged orthogonally in a first plane;

a first switching conductor configured in an orthogonally angled shape relative to the first plane;

a switching actuator mechanically connected to the first switching conductor, and configured to move vertically, relative to the first plane, to a first position and to a second position;

a third strip conductor arranged orthogonally to the first strip conductor and opposite to the second strip conductor relative to the first strip conductor in the first plane; and a second switching conductor configured in an orthogonally angled shape relative to the first plane; and wherein the switching actuator is mechanically connected to the second switching conductor, wherein the switching actuator is configured whereby, in the first position, the first strip conductor is in contact with the first switching conductor, the second strip conductor is in contact with the first switching conductor, and the first strip conductor and the third strip conductor are not in contact with the second switching conductor, and wherein the switching actuator is configured whereby, in the second position, the first strip conductor and the second strip conductor are not in contact with the first switching conductor, the first strip conductor is in contact with the second switching conductor, and the third strip conductor is in contact with the second switching conductor; and wherein the second strip conductor of a first of the at least two switches is connected to a first terminal of an electrical element, wherein the second strip conductor of a second of the at least two switches is connected to a second terminal of the electrical element, wherein the third strip conductor of the first switch is connected to the third strip conductor of the second switch, wherein the first strip conductor of the first switch forms an input terminal of the attenuation stage, and wherein the first strip conductor of the second switch forms an output terminal of the attenuation stage; and wherein an input terminal of the one attenuation stage forms an input terminal of the switchable attenuator, and an output terminal of the one attenuation stage forms an output terminal of the switchable attenuator.

18. The switchable attenuator of claim 17, comprising a plurality of attenuation stages, each comprising the one attenuation stage, wherein the plurality of attenuation stages are serially connected whereby an input terminal of a first of the serially connected attenuation stages forms an input terminal of the switchable attenuator, wherein for each of the serially connected attenuation stages an output terminal of a prior attenuation stage is connected to an input terminal of a following attenuation stage, and an output terminal of a final attenuation stage forms an output terminal of the switchable attenuator.

* * * * *